US005190437A

United States Patent [19]

Perry

[11] Patent Number: 5,190,437

[45] Date of Patent: Mar. 2, 1993

[54] MULTIPURPOSE LOADER ATTACHMENT FRAME AND COMPONENTS THEREFOR

[75] Inventor: Robert N. Perry, Welland, Canada

[73] Assignee: Deere & Company, Moline, Ill.

[21] Appl. No.: 819,165

[22] Filed: Jan. 9, 1992

[51] Int. Cl.[5] ..... B66C 1/00

[52] U.S. Cl. ..... 414/722; 414/24.5; 414/622

[58] Field of Search ..... 414/685, 622, 667, 671, 414/785, 24.5, 24.6, 910, 911, 912, 722; 37/DIG. 3

[56] References Cited

U.S. PATENT DOCUMENTS 3,817,567 6/1974 Lull ..... 414/622 X
4,032,184 6/1977 Blair .
4,056,205 11/1977 Etzler, IV .
4,120,405 10/1978 Jones ..... 414/24.5
4,395,188 7/1983 Kaup ..... 414/622
4,674,786 6/1987 Lynch ..... 414/24.5 X
4,850,789 7/1989 Zimmerman .

*Primary Examiner*—David A. Bucci
*Assistant Examiner*—Donald W. Underwood

[57] ABSTRACT

Various attachments for a tractor-mounted loader are formed by selecting different types of tines which may be selectively mounted to a common attachment frame which incorporates integral tine mounting bushings so that either a fork lift, bale fork or bale handling attachment with roll back support is formed.

13 Claims, 4 Drawing Sheets

MULTIPURPOSE LOADER ATTACHMENT FRAME AND COMPONENTS THEREFOR

BACKGROUND OF THE INVENTION

According to the present invention there is provided an attachment for a loader and more specifically there is provided an attachment frame.

It is known to provide a variety of attachments for mounting to loader arms. These attachments include such things as fork lift tines, round bale spears and bale squeezers. Some of these attachments constitute complete and separate units. This increases the cost to the manufacturers and dealers in supplying and stocking such attachments. Other manufactures provide common frames to which different parts may be bolted to form different attachments. However, this method requires more assembly time and increased maintenance to avoid loss of structural integrity due to bolts loosening.

SUMMARY OF THE INVENTION

According to the present invention, there is provided an improved attachment frame for use in forming different attachments.

An object of the invention is to provide a common attachment frame to which various parts may be attached, without the use of bolt-on brackets or other bolt connections, to the frame to form different attachments for connection to the arms of a tractor-mounted loader.

A more specific object of the invention is to provide a frame containing tine-mounting receptacles adapted for receiving an upper central and two lower spear-type tines to thereby form a bale fork; and the frame also containing integral bushings adapted for receiving transverse support rods adapted for either supporting fork lift tines or for supporting a combined bale lifting tine and roll back support structure.

Yet another object of the invention is to provide a common attachment frame and fork lift tine combination wherein the fork lift tines engage the frame such that they are prevented from tipping upwardly about their connection with transverse support rods carried by the frame.

Still another object of the invention is to provide a common attachment frame and bale lift tine combination wherein the bale lift tines are mounted for being hydraulically shifted towards and away from each other to permit them to be placed in straddling relationship to and then engaged with the lower portions of a large round bale.

These and other objects of the invention will become apparent from a reading of the ensuing description together with the appended drawings.

DESCRIPTION OF THE PREFERRED EMBODIMENT

Figure 1:
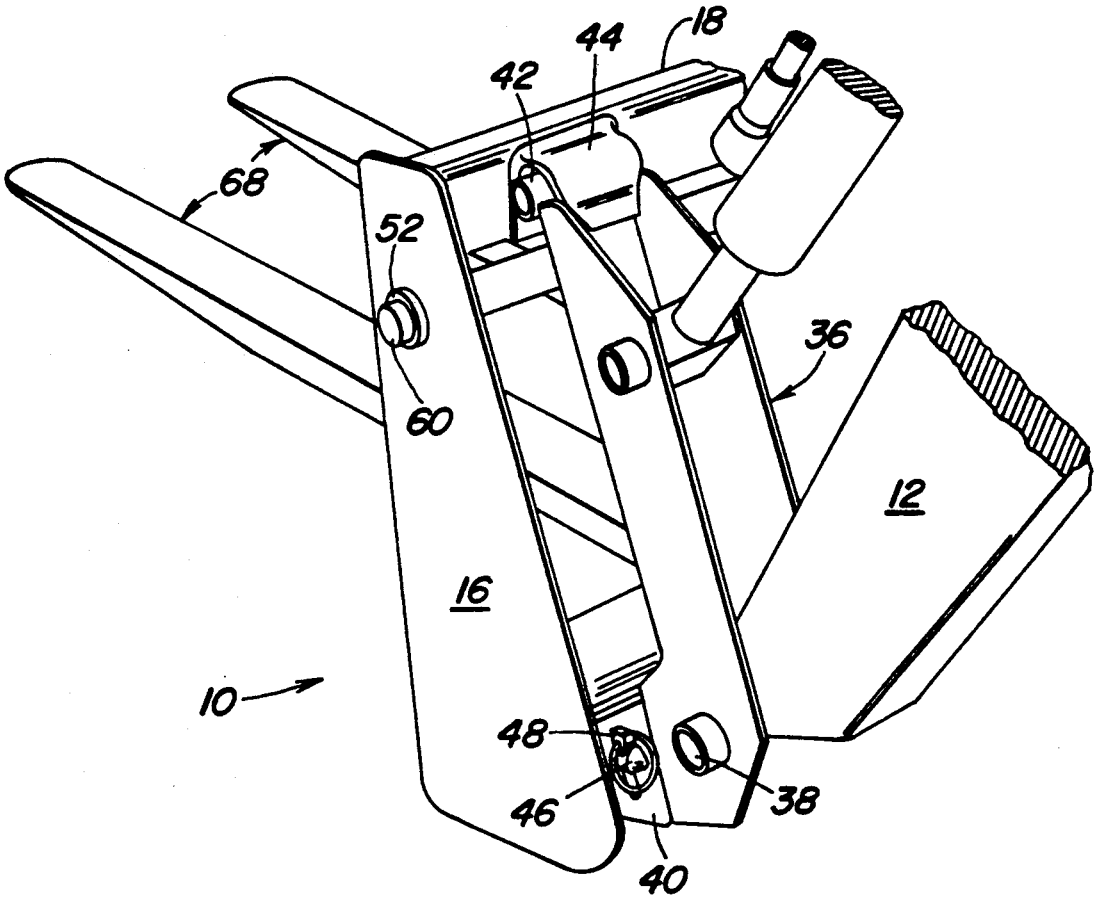
FIG. 1 is a left rear perspective view showing the coupling of the common mounting frame to the left loader arm of a tractor-mounted loader and showing the frame equipped with a pair of fork lift tines thus forming a fork lift attachment.
Figure 2:
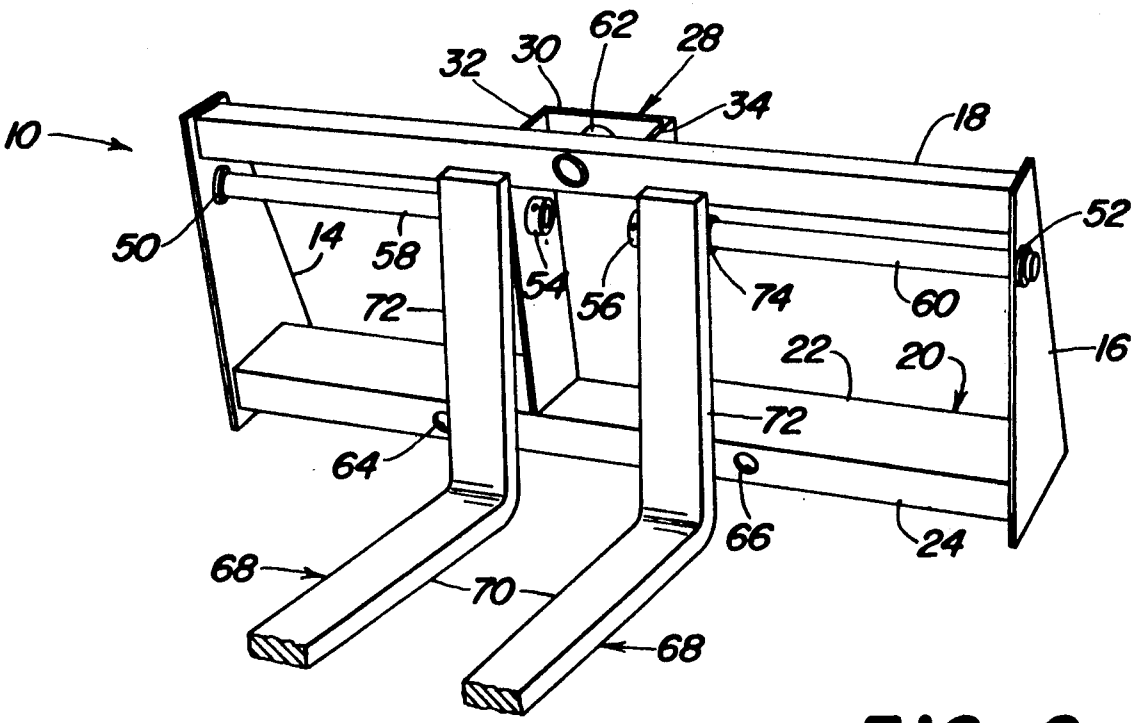
FIG. 2 is a left front perspective view of the fork lift attachment shown in FIG. 1.

Referring now to FIGS. 1 and 2, therein is shown an attachment frame 10 adapted for being coupled to forward ends of a pair of loader arms of which only the left arm 12 is shown. The frame 10 is in the form of a weldment including right and left vertical end plates 14 and 16 having upper ends joined by an upper horizontal cross member or beam 18 and lower ends joined by a lower horizontal cross member or beam 20. The upper cross member 18 is in the form of a tube having a rectangular cross-section while the lower cross member 20 is in the form of a downwardly opening channel having a horizontal web 22 joining a vertical front flange 24 and a rear flange 26 (FIG. 5) which includes an upper main portion, forming an angle slightly greater than 90° with the web, and a bottom end portion which extends forwardly at approximately a right angle from the main portion. Mounted centrally between the end plates 14 and 16 and extending between the web 22 of the lower cross member 20 and the upper cross member 18 is an upright member 28 in the form of a forwardly opening channel having a web 30 joined to right and left forwardly projecting flanges 32 and 34, respectively. Upper forward locations of the flanges 32 and 34 are notched to fit half the periphery of the upper cross member 18, the top end of the upright member 28 being even with the top of the cross member 18.

Each of the loader arms 12 has an upright, channel-like attachment carrier 36 vertically pivotally mounted thereto by a connection pin 38 received through opposite flanges of the carrier and through a forward end of the arm located between the flanges. An upright plate member 40 forms a lower front portion of the carrier 36 and a rod 42 forms and upper forward end of the carrier. Connection of the attachment carriers 36 with the attachment frame 10 is facilitated by means of downwardly opening hooks 44 that are welded to the backside of the upper cross member 18 at respective locations adjacent opposite ends thereof and by rearwardly projecting pins 46 that are welded at respective locations of the rear flange 26 of the lower cross member 20 located below and outboard of the hooks 44. Specifically, the rod 42 of each of the carriers 36 is received in an associated one of the hooks 44 while an aperture provided in each of the plates 40 is received on one of the pins 46. A latch pin 48 is inserted through a cross hole provided in each of the pins 46 to maintain the coupling between the carriers and the attachment frame.

The attachment frame 10 is constructed for having various attachment components connected thereto for forming various attachments for performing different functions. Specifically, integral attaching bushings 50, 52, 54 and 56 are respectively located in the end plates 14 and 16, and in the opposite flanges of the upright member 28 in axial alignment with each other at a level just beneath the upper cross member 18. Releasably received in the attaching bushings 50 and 54 is a tine support or mounting rod 58 which is held in place by a pin (not shown) inserted through aligned holes provided in the bushing 54 and the inner end of the rod 58.

A mounting rod 60 is similarly releasably mounted in the attaching bushings 52 and 56 and held in place by a pin inserted through the bushing 56 and rod 60. Provided in the upper cross member 18 at a central location between its opposite ends is an upper tine or spear attaching bushing 62 which has its rear end supported in the web 30 of the upright member 28. Spaced from each other and provided in the lower cross member 20 at locations at opposite sides of the upright member and equidistant from the upper bushing 62 are lower tine attaching bushings 64 and 66 which are supported in the front and rear flanges 24 and 26.

In FIGS. 1 and 2, it can be seen that a pair of fork lift tines 68 are mounted to the attachment frame 10. The tines 68 each include a forwardly projecting load-engaging section 70 and an upright section 72 extending upwardly from the rear of the section 70. A mounting bushing 74 is welded to the backside of the upright section 72 and is slidably received on a respective one of the mounting rods 58 and 60. Upper ends of the upright sections 72 of the tines 68 extend above the bottom of the upper cross member 18 so as to resist upward tipping of the tines. If desired, the tines 68 may be held in adjusted positions along the lengths of the mounting rods 58 and 60 by any well known means.

Figure 3:
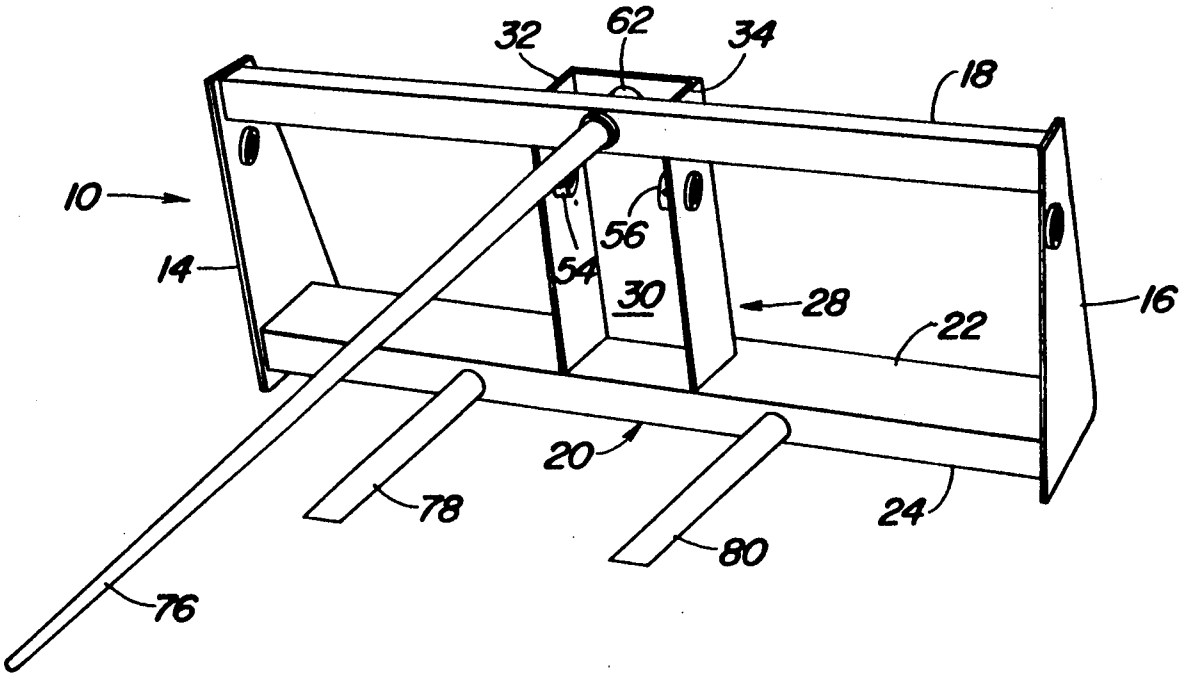
FIG. 3 is a perspective view like FIG. 2 but showing the common mounting frame equipped with bale tines or spears thus forming a bale fork attachment.

Referring now to FIG. 3, therein is shown the attachment frame 10 having components secured thereto to form a bale fork. Specifically, an upper elongate tine 76 is installed in the upper tine mounting bushing 62 by having a tapered rear end portion thereof (not shown) received in the bushing and held tightly therein by a nut tightened on a threaded rear end of the tine. A pair of lower, somewhat shorter tines 78 and 80 are installed in the lower tine mounting bushings 64 and 66 and held in place by a cross pin (not shown) which extends through aligned holes provided in rear portions of the bushings 64 and 66 and in the tines 78 and 80.

Figure 4:
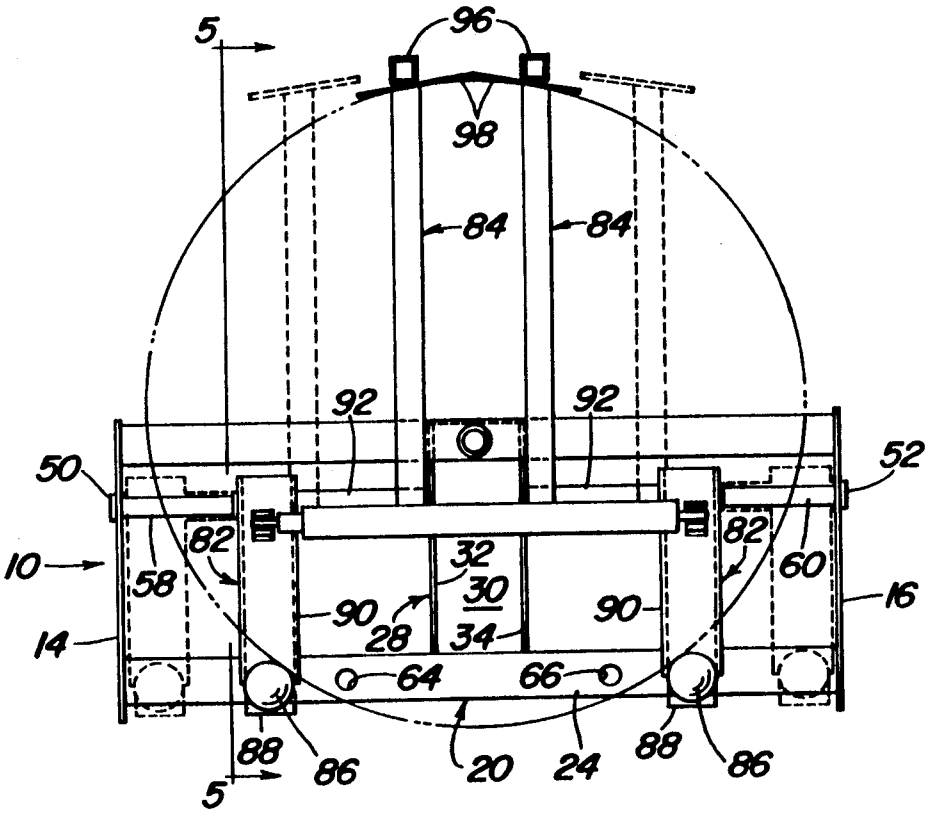
FIG. 4 is a front elevational view of the common frame equipped with a combined bale lift tines and roll back support structure.
Figure 5:
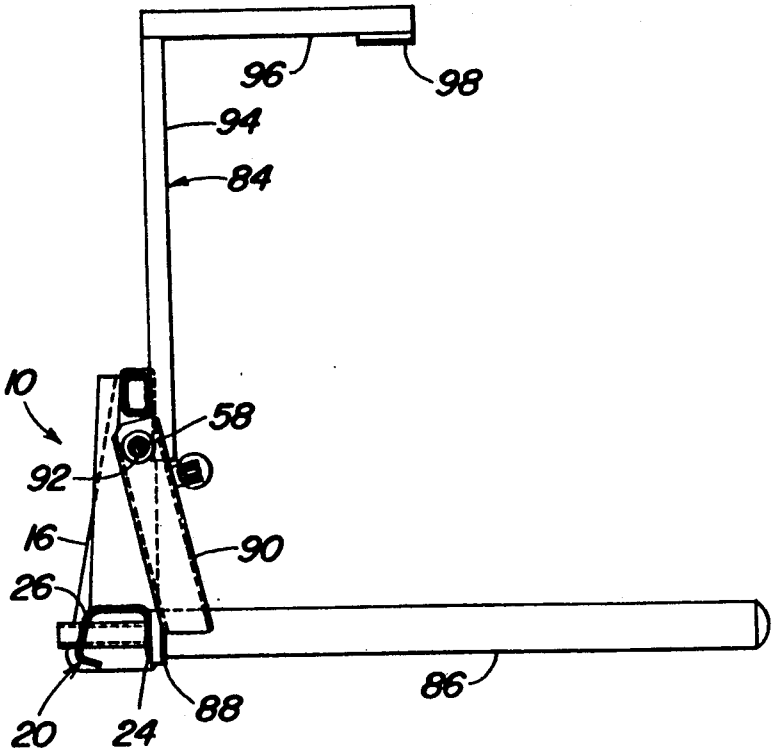
FIG. 5 is a vertical sectional view taken along line 5—5 of FIG. 4.

Referring now to FIGS. 4 and 5, therein is shown the attachment frame 10 having components secured thereto to form a large cylindrical or round bale lifting or handling attachment. Specifically, therein is shown a pair of attachment structures that each form a combined bale lift tine and rollback support including a tine portion 82 and a roll back support portion 84. The tine portion 82 includes an elongate, forwardly projecting, cylindrical bale lift tine 86. The tines 86 are relatively large and smooth which makes them particularly adapted for engaging large round bales that are covered with plastic wrap material since they are less apt to tear the material than are other tine constructions. A flat, upright plate 88 is provided at the rear end of each tine 86 and is slidably engaged with the front flange 24 of the lower cross member 20. Joined to and extending upwardly and rearwardly from a rear location of each of the bale lifting tines 86 is a tine mounting member 90 that is in the form of a tube having a rectangular or square cross section. The upper end of the mounting member 90 is disposed adjacent the upper cross member 18 so as to prevent the tines 86 from tipping upwardly. Slidably received on each of the mounting rods 58 and 60 is an elongate cylindrical bushing 92 which extends through and an upper location of an associated one of the mounting members 90, the bushing extending inwardly from such mounting member and having its inner end welded to a lower rear location of an upright roll back support post 94 forming part of the roll back support portion 84. Projecting forwardly from the top of the roll back support post 94 is a bale restraining arm 96 having a bale restraining pad 98 in the form of a rectangular plate welded to a forward underside location of the arm 96 and inclined upwardly from left to right as viewed from the front in FIG. 4. A hydraulic cylinder 100 is connected between the mounting members 90 and is operable for shifting the tines 86 and back support 84 between an inner position, as shown in solid lines in FIG. 4, wherein the restraining pads 98 are closely adjacent each other and the tines 84 are positioned at their inner most location for lifting a bale 102 (shown in phantom outline), and an outer position, as shown in dashed lines in FIG. 4, wherein the tines 84 are separated a maximum amount and are free from and in straddling relationship to the bale 102.

Thus, it will be appreciated that the attachment frame 10 has mounting bushings integrally embodied therein for selectively receiving various components to make up the three different functioning attachments respectively disclosed in FIGS. 2, 3 and 4. Thus, connection of the various components to the frame 10 may be accomplished without bolting on separate brackets, as is the case with prior art designs, and the attendant need for the operator to frequently check and retighten the bolted connections.

I claim:

1. A tractor-mounted loader attachment frame adapted for having first and second sets of different types of tines optionally mounted thereto comprising: a one-piece welded frame including upper and lower horizontal cross members extending between and joined to opposite parallel end plates making right angles with the cross members; an upright member located centrally between said end plates and extending between and being joined to said cross members; a first set of tine attaching bushings being integrally embodied in the opposite end plates and the upright member at respective locations adjacent to and below said upper cross member and being aligned with each other along an axis extending parallel to the upper cross member; and a second set of tine attaching bushings including a horizontal upper bushing extending perpendicular to and being carried by said upper cross member at a location midway between opposite ends thereof and first and second lower bushings oriented in parallel relationship to the upper bushing and being carried by the lower cross member at respective locations at opposite sides of said upright member and equidistant from said upper bushing, whereby said first set of tine attaching bushings are adapted for optionally receiving a tine support rod means on which is received a set of fork lift tines to thus form a fork lift attachment, and said second set of tine attaching bushings are adapted for optionally receiving the rear ends of spear-like tines to thus form a bale fork attachment.

2. The attachment frame as set forth in claim 1 wherein said upright member is in the form of a forwardly opening channel; and said first set of tine attaching bushings including a pair of bushing respectively mounted in opposite flanges of the channel.

3. The attachment frame as set forth in claim 2 wherein an upper forward portion of each of the flanges of said channel have a notch formed therein which is shaped complimentary to an exterior surface portion of said upper cross member; and said upper cross member being located in said notch.

4. The attachment frame as set forth in claim 3 wherein the upper tine attaching bushing of the second set of bushings extends through said upper cross member and through a web of the channel.

5. The attachment frame as set forth in claim 3 wherein said upper cross member is a tube of rectangular cross section; and the upper tine attaching bushing of the second set of bushings being mounted in the upper cross member and in a web of the channel.

6. An attachment for a tractor-mounted loader comprising: a one-piece, welded attachment frame including upper an lower cross members extending horizontally between and being joined to opposite end plates; an upright member located centrally between the end plates and having upper and lower ends thereof respectively joined to the upper and lower cross members; a plurality of tine mounting bushings being integral with the end plates and the upright member and being located just below the upper cross member in axial alignment with each other; tine supporting rod means being releasably received in said tine mounting bushings; a pair of laterally spaced load-lifting tines each including a rear portion defined by an upright section having an upper end disposed adjacent a front surface of the upper cross member and a load-engaging section extending forwardly from a lower end of the upright sections; a tubular receptacle being integral with a backside of each tine upright section and received on said rod means, whereby upward tilting of the fork lift tines is prevented by engagement of the upright sections with the upper cross member; and a roll back support including an upright roll back support located adjacent the upper cross member and inwardly of each upright tine sections; and said tubular receptacle interconnecting said upright post and upright tine section.

7. The attachment defined in claim 6 wherein said tines are flat fork lift tines.

8. The attachment defined in claim 6 wherein said load-engaging section of the tines is cylindrical; and a hydraulic cylinder being interconnected between the upright sections of the tines for shifting the latter so as to move the tines between respective outer and inner positions; whereby the attachment is particularly suited for lifting large cylindrical bales wrapped with plastic sheeting.

9. The attachment defined in claim 8 wherein said roll back support further includes a bale-restraining member joined to and projecting forwardly from an upper end of the upright post.

10. The attachment defined in claim 8 wherein said roll back support post is positioned forwardly of the upper cross member.

11. The attachment defined in claim 9 wherein said bale restraining member includes a bale restraining pad at a forward end thereof.

12. The attachment defined in claim 6 and further including a second plurality of tine mounting bushings including an upper bushing integral with said upper cross member at a location centrally between said end plates and a pair of lower tine bushings integral with said lower cross member at respective locations on opposite sides of said upright member and equidistant from said upper tine bushing, said second plurality of mounting bushings being adapted for receiving the rear ends of respective elongate, spear-like tines whereby the latter tines may be used in lieu of the aforementioned pair of tines to form a bale fork attachment.

13. An attachment for a tractor-mounted loader comprising: a one-piece, welded attachment frame including upper and lower cross members extending horizontally between and being joined to opposite end plates; an upright member located centrally between the end plates and having upper and lower ends thereof respectively joined to the upper and lower cross members; a first plurality of tine mounting bushings being integral with the end plates and the upright member and being located just below the upper cross member in axial alignment with each other and adapted for receiving rod means to which fork lift tines have been mounted to thereby cooperate with the attachment frame to form a fork lift attachment; a second plurality of tine mounting bushings including at least one upper bushing integral with the upper cross member and at lease two lower bushings integral with the lower cross member with the upper and lower bushings being so located relative to each other that when straight, spear-like tines are mounted in the upper and lower bushings they cooperate with the attachment frame to form a bale fork attachment.

* * * * *